US010247381B2

(12) United States Patent
Tsuda et al.

(10) Patent No.: US 10,247,381 B2
(45) Date of Patent: Apr. 2, 2019

(54) AUTOMOTIVE LAMP

(71) Applicant: Koito Manufacturing Co., Ltd., Minato-ku, Tokyo (JP)

(72) Inventors: Toshiaki Tsuda, Shizuoka (JP); Tomoyuki Ichikawa, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 696 days.

(21) Appl. No.: 14/824,556

(22) Filed: Aug. 12, 2015

(65) Prior Publication Data

US 2015/0345728 A1 Dec. 3, 2015

Related U.S. Application Data

(63) Continuation of application No. PCT/JP2014/000545, filed on Feb. 3, 2014.

(30) Foreign Application Priority Data

Feb. 18, 2013 (JP) ..... 2013-029239

(51) Int. Cl.
*F21S 41/14* (2018.01)
*F21S 41/16* (2018.01)
(Continued)

(52) U.S. Cl.
CPC ..... *F21S 41/29* (2018.01); *F21S 41/14* (2018.01); *F21S 41/16* (2018.01); *F21S 41/19* (2018.01);
(Continued)

(58) Field of Classification Search
CPC ..... F21S 48/1208; F21S 48/1145; F21S 48/1241; F21S 41/29; F21S 41/14; F21S 41/24; F21Y 2115/30
See application file for complete search history.

(56) References Cited

U.S. PATENT DOCUMENTS 7,758,224 B2 * 7/2010 Hama ..... A61B 1/0653 362/231
8,569,942 B2 * 10/2013 Kishimoto ..... F21S 48/1154 313/483
(Continued)

FOREIGN PATENT DOCUMENTS

EP 1734302 A1 12/2006
JP 2011-222238 A 11/2011
(Continued)

OTHER PUBLICATIONS

International Preliminary Report on Patentability (Form PCT/IB/373) and the Written Opinion of the International Searching Authority (Form PCT/ISA/237) dated Aug. 18, 2015, in the corresponding International Application No. PCT/JP2014/000545. (9 pages).
International Search Report (Form PCT/ISA/210) dated Mar. 4, 2014, in the corresponding International Application No. PCT/JP2014/000545. (5 pages).
(Continued)

*Primary Examiner* — William N Harris

(57) ABSTRACT

An automotive lamp includes: a light source; a light emitting member that receives light from the light source and emits light; and a support member that supports the light emitting member. The support member includes a translucent light emitting member accommodating unit. The light emitting member accommodating unit includes a recess in which the light emitting member is accommodated. A light incidence surface and side surfaces of the light emitting member are in contact with the light emitting member accommodating unit in a state in which the light emitting member is accommodated in the recess.

16 Claims, 4 Drawing Sheets

(51) Int. Cl.

| | |
|---|---|
| ***F21S 41/19*** | (2018.01) |
| ***F21S 41/29*** | (2018.01) |
| ***F21S 45/47*** | (2018.01) |
| ***F21Y 115/10*** | (2016.01) |
| ***F21Y 115/30*** | (2016.01) |

(52) U.S. Cl.

CPC ..... *F21S 41/192* (2018.01); *F21S 45/47* (2018.01); *F21Y 2115/10* (2016.08); *F21Y 2115/30* (2016.08)

(56) References Cited

U.S. PATENT DOCUMENTS

| | | | | |
|---|---|---|---|---|
| 8,708,537 | B2 * | 4/2014 | Takahashi | F21S 48/1145 362/259 |
| 9,631,794 | B2 * | 4/2017 | Kamee | F21V 13/08 |
| 2009/0003400 | A1 | 1/2009 | Nagahama et al. | |
| 2011/0249460 | A1 | 10/2011 | Kushimoto | |
| 2012/0051074 | A1 | 3/2012 | Takahashi | |
| 2012/0051377 | A1 | 3/2012 | Liang et al. | |
| 2012/0243203 | A1 | 9/2012 | Koike et al. | |
| 2013/0208496 | A1 * | 8/2013 | Kishimoto | F21V 9/16 362/553 |
| 2013/0335989 | A1 | 12/2013 | Sato et al. | |

FOREIGN PATENT DOCUMENTS

| | | | |
|---|---|---|---|
| JP | 2011233821 | A | 11/2011 |
| JP | 2012-054084 | A | 3/2012 |
| JP | 2012-069908 | A | 4/2012 |
| JP | 2012-074354 | A | 4/2012 |
| JP | 2012-203995 | A | 10/2012 |
| JP | 2012-221634 | A | 11/2012 |
| JP | 2012-252838 | A | 12/2012 |
| JP | 2013030380 | A | 2/2013 |
| WO | 2007/105647 | A1 | 9/2007 |
| WO | 2009115976 | A1 | 9/2009 |
| WO | 2012/121343 | A1 | 9/2012 |
| WO | 2013/018503 | A1 | 2/2013 |

OTHER PUBLICATIONS

Office Action dated Apr. 24, 2017, by the Chinese Patent Office in corresponding Chinese Patent Application No. 201480009258.6 and English translation of the Office Action. (14 pages).

Chinese Office Action dated Sep. 2, 2016 issued in corresponding Chinese Patent Appln. No. 2014800092586, with English translation (17 pages).

Extended European Search Report dated Oct. 24, 2016 issued in corresponding European Patent Appln. No. 14751006.9, with English translation (7 pages).

Office Action (Notification of Reason(s) for Refusal) dated Dec. 7, 2016, by the Korean Patent Office in corresponding Korean Patent Application No. 10-2015-7025348, and an English Translation of the Office Action. (14 pages).

Office Action for corresponding JP application No. 2015-5000133, (dated Nov. 21, 2017), JPO.

Office Action issued for the corresponding Japanese Patent Application No. 2015-500133, dated May 22, 2018.

Office Action issued for corresponding JP Patent Application No. 2015-500133, dated Feb. 19, 2019.

* cited by examiner

AUTOMOTIVE LAMP

BACKGROUND OF THE INVENTION

1. Field of the Invention

The present invention relates to an automotive lamp and, more particularly, to an automotive lamp used in a vehicle such as a motorcar.

2. Description of the Related Art

Patent document 1 discloses a light emitting device including a laser diode, and a solid phosphor glass excited by the light emitted by the laser diode and emitting light of a color different from the color of the light emitted by the laser diode. The laser diode in this light emitting device is surrounded by a reflector, and the phosphor glass is supported at an open end of the reflector by a translucent member made of, for example, transparent glass. The translucent member is in contact with the side of the phosphor glass and supports the phosphor glass.

[patent document 1] Pamphlet of WO07/105647

We have made intensive study on automotive lamps in which a laser light source is used and found out that there is room for improvement in related-art light emitting devices for use as a laser light source in that degradation in light emitting efficiency of a light emitting member such as a phosphor due to generated heat should be mitigated.

SUMMARY OF THE INVENTION

The present invention addresses the issue and a purpose thereof is to provide a technology for mitigating degradation in light emitting efficiency of a light emitting member.

An embodiment of the present invention relates to an automotive lamp. The automotive lamp includes: a light source; a light emitting member that receives light from the light source and emits light; and a support member that supports the light emitting member. The support member includes a translucent light emitting member accommodating unit. The light emitting member accommodating unit includes a recess in which the light emitting member is accommodated. A light incidence surface and side surfaces of the light emitting member are in contact with the light emitting member accommodating unit in a state in which the light emitting member is accommodated in the recess.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
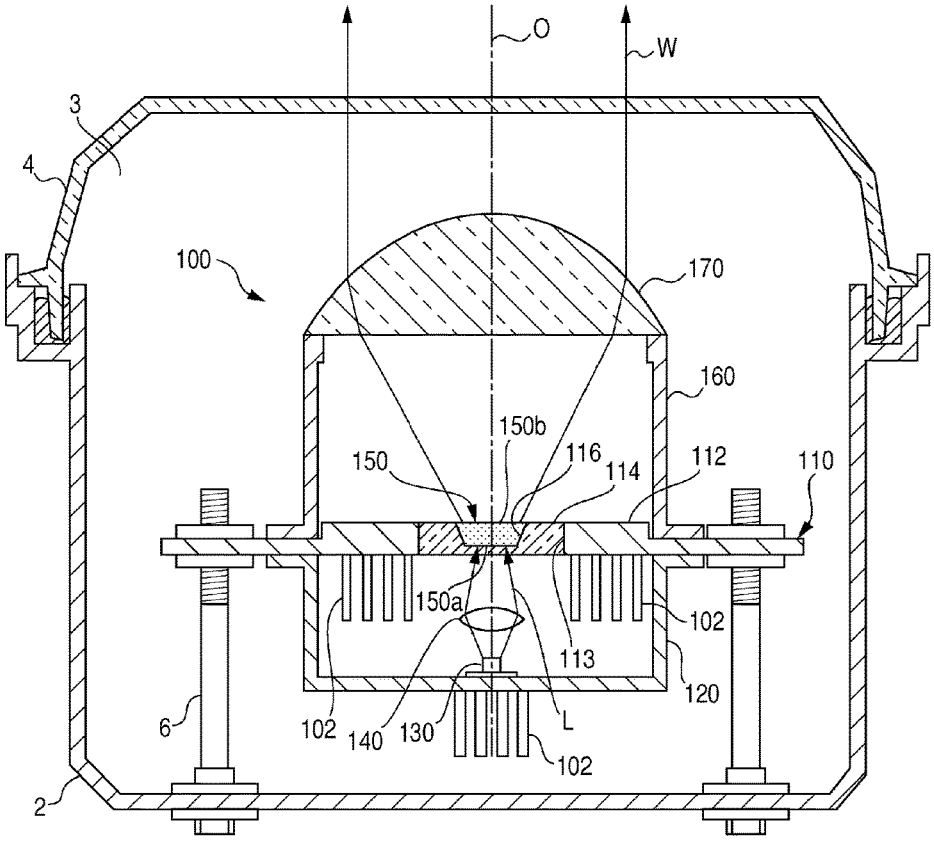
FIG. 1 is a horizontal cross sectional view showing the schematic structure of the automotive lamp according to the first embodiment.

An embodiment of the present invention relates to an automotive lamp. The automotive lamp includes: a light source; a light emitting member that receives light from the light source and emits light; and a support member that supports the light emitting member. The support member includes a translucent light emitting member accommodating unit. The light emitting member accommodating unit includes a recess in which the light emitting member is accommodated. A light incidence surface and side surfaces of the light emitting member are in contact with the light emitting member accommodating unit in a state in which the light emitting member is accommodated in the recess.

According to this embodiment, degradation in light emitting efficiency of a light emitting member is mitigated.

The light emitting member accommodating unit may include a plurality of recesses, and the light emitting member may be accommodated in each of the plurality of recesses. According to this embodiment, degradation in light emitting efficiency of a light emitting member is mitigated more properly. On a surface of the light emitting member accommodating unit that is contact with the light emitting member is provided a rough surface area having a surface roughness greater than that of a light incidence surface of the light emitting member accommodating unit. According to this embodiment, degradation in light emitting efficiency of a light emitting member is mitigated more properly.

In any of the foregoing embodiments, the light incidence surface of the light emitting member may have a shape collapsed in one direction as viewed in the direction of a normal to the light incidence surface, and the light source may be a laser light source and a beam pattern of laser light radiated from the light source may have a shape collapsed on the light incidence surface of the light emitting member in the same direction as the direction in which the light incidence surface of the light emitting member is collapsed. According to this embodiment, light emitting efficiency of a light emitting member is improved.

The automotive lamp according to any of the foregoing embodiments may further include a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape. According to this embodiment, light emitting efficiency of a light emitting member is improved.

The automotive lamp according to any of the foregoing embodiments may further include a translucent cover member that is in contact with a light emission surface of the light emitting member and with the support member. According to this embodiment, degradation in light emitting efficiency of a light emitting member is mitigated more properly.

A description will be given of an embodiment of the present invention with reference to the drawings. Like numerals represent like elements so that the description will be omitted accordingly. The embodiments of the present invention are not limited to those described above and appropriate combinations or replacements of the features of the embodiments are also encompassed by the present invention.

(First Embodiment)

FIG. 1 is a horizontal cross sectional view showing the schematic structure of the automotive lamp according to the first embodiment. An automotive lamp 1 according to the embodiment is an automotive head lamp apparatus provided with, for example, a pair of head lamp units disposed on the left and right of the front of a vehicle. The pair of head lamp units have substantially the same structure so that FIG. 1 shows the structure of only one of the left and right units to represent the automotive lamp 1. The automotive lamp 1 is provided with a lamp body 2 that opens to a space in front of the vehicle and a translucent cover 4 fitted to cover the opening of the lamp body 2. The translucent cover 4 is formed of translucent resin or glass. A lamp unit 100 is accommodated in a lamp chamber 3 formed by the lamp body 2 and the translucent cover 4.

The lamp unit 100 is of so-called projection type and is provided with a support member 110, a light source mount 120, a light source 130, a condensing lens 140, a light emitting member 150, a lens holder 160, and a projection lens 170.

The support member 110 is a member for supporting the light emitting member 150. The support member 110 is a substantially plate-shaped member formed of a metal material such as aluminum. The two main surfaces of the support member 110 are disposed to face the space in front of and behind the lamp. The support member 110 includes an opening 113 at the center that extends through the support member 110 in the front-back direction of the lamp. The light emitting member 150 is disposed in the opening 113. The light source 130 and the condensing lens 140 are fixed, via the light source mount 120, on the main surface of the support member 110 facing the space behind the lamp. The projection lens 170 is fixed, via the lens holder 160, on the main surface of the support member 110 facing the space in front of the lamp. Therefore, the support member 110 also functions as a member for supporting the light source 130, the condensing lens 140, and the projection lens 170.

The support member 110 is provided with thread holes at predetermined positions in the circumferential edge. Aiming screws 6 extending forward through the lamp body 2 are threadably engaged with the thread holes. In this way, the support member 110 is mounted in the lamp body 2. The automotive lamp 1 is configured such that a light axis O of the lamp unit 100 can be adjusted horizontally or vertically by using the aiming screws 6.

The light source mount 120 is a member having a shape of a bottomed cylinder formed of a metal material such as aluminum. The open end of the light source mount 120 is fixed by, for example, welding to the main surface of the support member 110 facing the space behind the lamp. The light source 130 fixed to the inner surface of the bottom of the light source mount 120 and a plurality of heat dissipating fins 102 are fixed to the outer surface of the bottom. The heat generated by the light source 130 is dissipated via the light source mount 120 and the heat dissipating fins 102.

The light source 130 is a laser light source formed by a laser diode (semiconductor laser) emitting laser light L. The structure of the laser diode forming the light source 130 is publicly known so that a detailed description thereof is omitted. The light source 130 is fixed to the inner surface of the bottom of the light source mount 120 such that the light emission surface faces the space in front of the lamp. The condensing lens 140 condenses the laser light L emitted by the light source 130. The condensing lens 140 is disposed between the light source 130 and the light emitting member 150 and is fixed to the light source mount 120. The laser light L emitted by the light source 130 is condensed by the condensing lens 140 and is incident on the light emitting member 150. Instead of the condensing lens 140, the lamp unit 100 may alternatively be provided with a collimating lens for transforming the laser light L emitted by the light source 130 into parallel light.

The light emitting member 150 is a member that receives the light from the light source and emits light. In this embodiment, the light emitting member 150 is formed by a phosphor configured to receive the laser light L from the light source 130 and emits light having a wavelength different from the laser light L (e.g., light having a longer wavelength than the laser light L). The light emitting member 150 includes a light incidence surface 150*a* on which the laser light L is incident and a light emission surface 150*b* from which the light generated inside the light emitting member 150 is emitted. The light emission surface 150*b* represents the light emission surface of the light emitting member 150.

The automotive lamp 1 according to the embodiment is configured to excite the light emitting member 150 by irradiating the light emitting member 150 with the laser light L and radiate non-coherent light generated as a result. Exemplary combinations of the light source 130 and the light emitting member 150 are described below.

In one combination, the light source 130 is implemented by a laser diode for radiating blue laser light and the light emitting member 150 is implemented by a member containing a phosphor adapted to subject the blue laser light to wavelength conversion to produce yellow light. For example, the light emitting member 150 is formed of a resin that contains a yellow light emitting phosphor and is translucent. The light emitting member 150 may be a phosphorescent ceramic produced by sintering a transparent ceramic base containing a phosphor material, or a glass containing a phosphor material. In this combination, when the blue laser light emitted by the light source 130 is incident on the light emitting member 150 via the light incidence surface 150*a* of the light emitting member 150, a portion of the light is subject to wavelength conversion by the light emitting member 150 and turned into yellow light before being emitted from the light emission surface 150*b*. The light emitting member 150 generates heat as the laser light L is subject to wavelength conversion. The remaining portion of the blue laser light is transmitted through the light emitting member 150 and emitted from the light emission surface 150*b*. The yellow light generated in the light emitting member 150 and the blue laser light transmitted through the light emitting member 150 are mixed and turned into white light W, which travels toward the projection lens 170.

In another combination, the light source 130 is implemented by a laser diode for radiating ultraviolet laser light and the light emitting member 150 is implemented by a member containing a blue light emitting phosphor adapted to subject the ultraviolet light to wavelength conversion to produce blue light and a yellow light emitting phosphor adapted to subject the ultraviolet light to wavelength conversion to produce yellow light. In this combination, the ultraviolet light emitted by the light source 130 is subject to wavelength conversion by the light emitting member 150 to produce blue light and yellow light. The blue light and the yellow light are subject to additive color mixing and turned into white light W before being emitted by the light incidence surface 150*b*. Alternatively, the blue light and the yellow light generated are emitted from the light emitting member 150 and subject to additive color mixing. The resultant white light W travels toward the projection lens 170.

The light emitting member 150 is supported by the support member 110 and is disposed between the condensing lens 140 and the projection lens 170. The support member 110 includes a substantially plate-shaped body 112 formed of a metal material such as aluminum and a translucent and substantially plate-shaped light emitting member accommodating unit 114. The body 112 includes an opening 113 at the center and thread holes at the circumferential edge. The aiming screws 6 are engaged with the thread holes. A plurality of heat dissipating fins 102 are fixed to the main surface of the body 112 facing the space behind the lamp.

The light emitting member accommodating unit 114 is fitted in the opening 113 and is disposed between the condensing lens 140 and the projection lens 170. The light emitting member accommodating unit 114 includes a recess 116 on the main surface thereof facing the space in front of the lamp to accommodate the light emitting member 150. The support member 110 supports the light emitting member 150 by accommodating the light emitting member 150 in the recess 116. The main surface of the light emitting member accommodating unit 114 facing the space behind the lamp is configured as a light incidence surface 114*a* of the light emitting member accommodating unit on which the laser light L is incident. The light emitting member accommodating unit 114 is translucent and so can transmit the laser light L. Further, the light emitting member accommodating unit 114 does not substantially include a phosphor.

The light emitting member accommodating unit 114 is translucent and is formed of a material having a higher thermal conductivity than air (thermal conductivity: about 0.02 W/m·k). Examples of the material forming the light emitting member accommodating unit 114 include polycrystalline alumina ($Al_2O_3$, thermal conductivity: 20-30 W/m·k), sapphire (monocrystal $Al_2O_3$, thermal conductivity: 20-30 W/m·k), yttria ($Y_2O_3$, thermal conductivity: 20-30 W/m·k), YAG ($Y_3Al_5O_{32}$, thermal conductivity: 5-15 W/m·k), glass (thermal conductivity: about 1 W/m·k), etc. To meet the need for translucency, rigidity, thermal conductivity, availability, cost, etc., polycrystalline alumina is preferable as a material for forming the light emitting member accommodating unit 114. It is preferable that the average grain diameter of the crystal grain of polycrystalline alumina be 50-70 μm. By configuring the average grain diameter to be 50 μm or larger, the light emitting member accommodating unit 114 can be more translucent. By configuring the average grain diameter to be 70 μm or less, the light emitting member accommodating unit 114 can be more rigid.

The lens holder 160 is a cylindrical member formed of a metal material such as aluminum. One of the open ends thereof is fixed by, for example, welding to the main surface of the support member 110 facing the space in front of the lamp. The projection lens 170 is fixed to the open end of the lens holder 160 facing the space in front of the lamp. The projection lens 170 is comprised of a plano-convex aspherical lens in which the front surface is convex and the back surface is planar. The projection lens 170 projects a light source image formed on the back focal plane including the back focal point of the projection lens 170 onto a virtual vertical screen in front of the lamp as an inverted image. The projection lens 170 is disposed such that the back focal point is located on the light axis O of the lamp unit 100 and in the vicinity of the light emission surface 150*b* of the light emitting member 150.

The laser light L radiated by the light source 130 is incident on the light emitting member accommodating unit 114 via the condensing lens 140 and the light incidence surface 114*a* of the light emitting member accommodating unit. The laser light L incident on the light emitting member accommodating unit 114 travels in the light emitting member accommodating unit 114 and is incident on the light emitting member 150 via the light incidence surface 150*a* of the light emitting member. The laser light L incident on the light emitting member 150 is subject to wavelength conversion in the light emitting member 150. The white light W produced as a result is emitted from the light emission surface 150*b* of the light emitting member 150, is incident on the projection lens 170, and is projected by the projection lens 170 in front of the lamp as substantially parallel light.

Figure 2A:
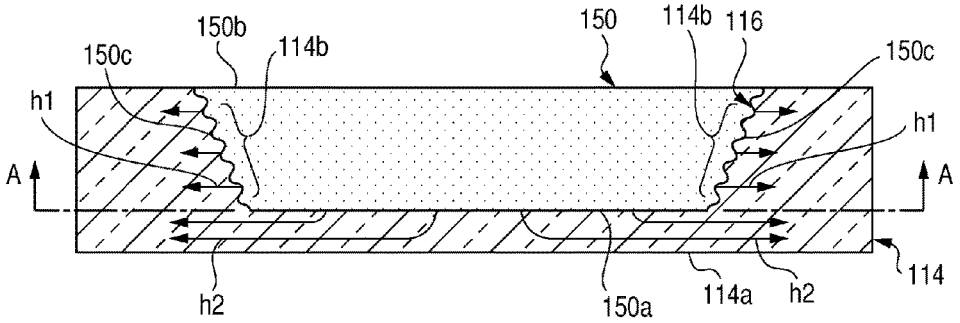
FIG. 2A is a horizontal cross sectional view showing the schematic structure of the light emitting member and the light emitting member accommodating unit of the automotive lamp according to the first embodiment.

A detailed description will be given of the structure to support the light emitting member 150 and the heat dissipating mechanism. FIG. 2A is a horizontal cross sectional view showing the schematic structure of the light emitting member and the light emitting member accommodating unit of the automotive lamp according to the first embodiment. As shown in FIG. 2A, the light incidence surface 150*a* and side surfaces 150*c* of the light emitting member 150 are in contact with the light emitting member accommodating unit 114 in a state in which the light emitting member 150 is accommodated in the recess 116. Therefore, most of the heat generated as the laser light L is subject to wavelength conversion in the light emitting member 150 is dissipated in part to the light emitting member accommodating unit 114 via the side surfaces 150*c* as indicated by arrow h1 and is also dissipated in part to the light emitting member accommodating unit 114 via the light incidence surface 150*a* of the light emitting member as indicated by arrow h2. The heat dissipated to the light emitting member accommodating unit 114 is conducted to the body 112 and the heat dissipating fins 102 and dissipated to the atmosphere.

On the surface of the light emitting member accommodating unit 114 that is contact with the light emitting member 150 is provided a rough surface area 114*b* having a surface roughness greater than that of the light incidence surface 114*a* of the light emitting member accommodating unit. Of the surfaces of the light emitting member accommodating unit 114 according to this embodiment, the rough surface area 114*b* is provided on the surface in contact with the side surfaces 150*c* of the light emitting member 150. The rough surface area 114*b* includes micro-asperities and is formed by roughing the surface of the light emitting member accommodating unit 114 by, for example, etching. It is preferable that the rough surface area 114*b* be formed on the side of the recess 116 rather than on the bottom thereof in order not to block incidence of the laser light L on the light emitting member 150. The rough surface area 114*b* may be provided on the bottom of the recess 116. For example, by providing the rough surface area 114*b* on the bottom of the recess 116 as well as on the side thereof, the heat dissipating efficiency of the light emitting member 150 is improved.

Figure 2B:
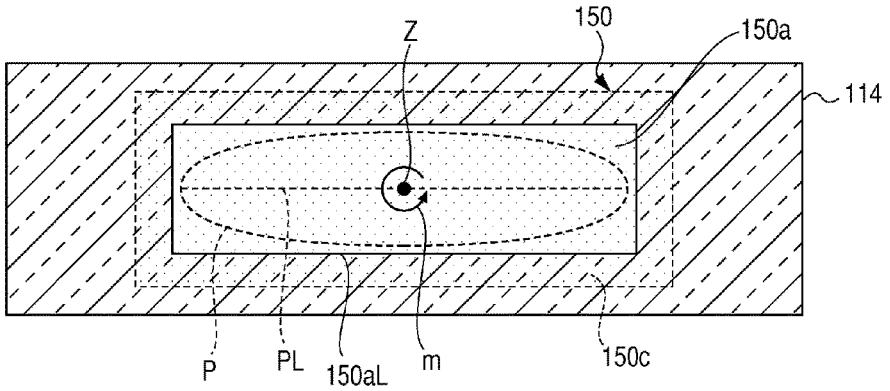
FIG. 2B is a cross sectional view along line A-A of FIG. 2A.

A description will now be given of the relationship between the shape of the light incidence surface 150*a* of the light emitting member and the beam pattern of the laser light L radiated by the light source 130. FIG. 2B is a cross sectional view along line A-A of FIG. 2A. FIG. 2B shows the light incidence surface 150*a* of the light emitting member as viewed in the direction of a normal to the light incidence surface 150*a* of the light emitting member. As shown in FIG. 2B, the light incidence surface 150*a* of the light emitting member has a shape collapsed in one direction as viewed in the direction of a normal to the light incidence surface 150*a* of the light emitting member. Further, the beam pattern P of the laser light L radiated from the light source 130 has a shape collapsed on the light incidence surface 150*a* of the light emitting member in the same direction as the direction in which the light incidence surface 150*a* of the light emitting member is collapsed.

For example, the light incidence surface 150*a* of the light emitting member and the beam pattern P of the laser light L have a shape having a longer side and a shorter side, or a longer diameter and a shorter diameter (e.g., rectangle, ellipse, oblong shape). On the light incidence surface 150*a* of the light emitting member, the longer side or the longer diameter of the light incidence surface 150*a* of the light emitting member, and the longer side or the longer diameter of the beam pattern P are aligned in a direction defined around the normal Z of the light incidence surface 150*a* of the light emitting member (the direction indicated by arrow m in the figure). In other words, the orientation of the light emitting member 150 with respect to the light source 130 is defined such that the longer side or the longer diameter of the light incidence surface 150*a* of the light emitting member and the longer side or the longer diameter of the beam pattern P are parallel. In this embodiment, the light incidence surface 150*a* of the light emitting member is substantially rectangular and the beam pattern P is substantially elliptical or substantially oblong. A longer side 150*a*L of the light incidence surface 150*a* of the light emitting member and a longer diameter PL of the beam pattern P are parallel to each other. Stated otherwise, the light incidence surface 150*a* of the light emitting member and the beam pattern P of the laser light L on the light incidence surface 150*a* of the light emitting member are substantially equal in shape or substantially analogous in shape.

As described above, the support member 110 of the automotive lamp 1 according to the embodiment includes the light emitting member accommodating unit 114 having the recess 116. The light emitting member 150 is accommodated in the recess 116 and the light incidence surface 150*a* and the side surfaces 150*c* of the light emitting member are in contact with the light emitting member accommodating unit 114. In this embodiment, the light incidence surface 150*a* and the four side surfaces 150*c* of the light emitting member are in contact with the light emitting member accommodating unit 114. This allows the heat generated in the light emitting member 150 to be conducted to the light emitting member accommodating unit 114 having a high thermal conductivity via the light incidence surface 150*a* of the light emitting member as well as via the side surfaces 150*c* of the light emitting member 150. Therefore, the heat dissipating performance of the light emitting member 150 is increased as compared with a structure in which the heat is dissipated to the support member only via the side surfaces of the light emitting member. This mitigates degradation in light emitting efficiency (conversion efficiency of laser light) of the light emitting member 150 that occurs due to generated heat. Consequently, the luminance of the light emitting member 150 can be increased and the light irradiation performance of the automotive lamp 1 is improved. In the case that silicone resin is used for the binder member of the phosphor, the thermal conductivity of the light emitting member 150 is about 0.2 W/m·k.

For the purpose of increasing the luminance of the light emitting member 150, it is useful to decrease the area on the light incidence surface 150*a* of the light emitting member irradiated by the laser light L. In this case, a small area will be irradiated by high-energy light with the result that the temperature of the light emitting member 150 is likely to increase. This is addressed by the embodiment by increasing the heat dissipating efficiency of the light emitting member 150. It is therefore easy to realize a design for increasing the luminance of the light emitting member 150.

Further, since the recess 116 holds the light emitting member 150 in place, the likelihood of dislocation of the light emitting member 150 from the support member 110 is reduced. It also makes it possible to attempt to restrain an increase in the number of components to build the automotive lamp 1 and the number of steps for assembly.

For example, the light emitting member 150 is formed as described below. In other words, a phosphor is first mixed with a liquid or gelatinous binder member to produce a phosphor paste. The phosphor paste is then poured into the opening of the support member. The binder member in the phosphor paste is cured by, for example, calcination. The light emitting member 150 is formed through the steps described above. Alternatively, the preformed light emitting member 150 is set in the opening. For example, silicone resin, fluorine resin, etc. is used for the binder member.

The automotive lamp 1 according to the embodiment is configured such that the light emitting member 150 is accommodated in the recess 116 of the light emitting member accommodating unit 114. Therefore, the light emitting member 150 may be formed by using the recess 116 as a mold form (guide) for the phosphor paste, pouring the phosphor paste into the recess 116, and calcinating the phosphor paste within the recess 116. Therefore, the light emitting member 150 can be manufactured easily and the steps of manufacturing the automotive lamp 1 is simplified. Since the recess 116 is used as a mold form, the edge portions of the light emitting member 150 can be formed accurately. Accordingly, accuracy of dimension of the light emitting member 150 can be increased. Further, the shape of the light emitting member 150 can be maintained stably. It should be particularly noted that the thickness of the light emitting member 150 is normally about 0.7 mm, which is very thin. It is therefore difficult to achieve precision in thickness. By forming the light emitting member 150 by filling the recess 116 with the phosphor paste, the light emitting member 150 can be formed with a highly accurately defined thickness. Moreover, the thickness of the light emitting member 150 can be easily changed by changing the depth of the recess 116. The shapes of the light incidence surface 150*a* and the light emission surface 150*b* of the light emitting member can be easily changed by changing the shape of the recess 116.

The surface of the light emitting member accommodating unit 114 that is contact with the light emitting member 150 is provided with the rough surface area 114*b* having a surface roughness greater than that of the light incidence surface 114*a* of the light emitting member accommodating unit. This increases the area of contact between the light emitting member 150 and the light emitting member accommodating unit 114 and so can increase the heat dissipating efficiency of the light emitting member 150 and mitigate degradation in light emitting efficiency of the light emitting member 150. Also, the likelihood of dislocation of the light emitting member 150 from the support member 110 is reduced. The surface of the light emitting member accommodating unit 114 that is in contact with the light emitting member 150 may be provided with a reflecting film in place of or in addition to the rough surface area 114*b*. This increases the luminance of the light emitting member 150. The reflecting film may be exemplified by a film adapted to reflect light in the entire range of visible light wavelength, or a film adapted to transmit light having a wavelength found in a portion of the visible light wavelength range and reflect light having a wavelength found in the remainder of the visible light wavelength range. The reflecting film adapted to transmit light having a wavelength found in a portion of the visible light wavelength is exemplified by a film adapted to transmit light having a wavelength in a region of blue light (380-480 nm) and reflect light having a wavelength in green, yellow, and red regions (480-780 nm).

In a lamp structure in which the light emitting member 150 is excited by the laser light L to radiate noncoherent light generated as a result, improvement in utilization ratio of the laser light L is a challenge. This is addressed by the embodiment by configuring the light emitting member 150 to be collapsed in one direction as viewed in the direction of a normal to the light incidence surface 150*a* of the light emitting member. Further, the beam pattern P of the laser light L radiated from the light source 130 has a shape collapsed on the light incidence surface 150*a* of the light emitting member in the same direction as the direction in which the light emitting member 150 is collapsed. By synchronizing the shapes of the light incidence surface 150*a* of the light emitting member and of the beam pattern P in a direction defined around the light axis of the light source 130 (the direction indicated by arrow m in the figure), the laser light L can be incident on the light emitting member 150 efficiently. This improves the external quantum efficiency of the light emitting member 150 and improves the light emitting efficiency of the light emitting member 150.

The light emission surface 150*b* of the light emitting member 150 according to the embodiment is rectangular. Since a light distribution pattern can be formed by using the rectangular light emitting member, light distribution control is simplified.

The following variations to the automotive lamp 1 according to the embodiment are possible.

(Variation 1)

Figure 3A:
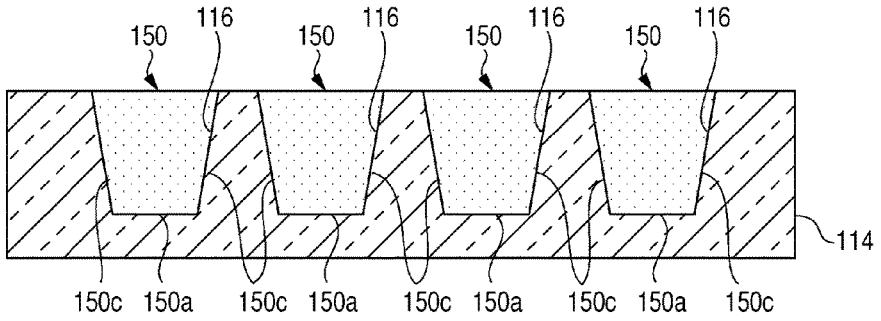
FIG. 3A is a horizontal cross sectional view showing the schematic structure of the light emitting member and the light emitting member accommodating unit of the automotive lamp according to variation 1.

The structure of the automotive lamp 1 according to variation 1 is similar to that of the automotive lamp 1 according to the first embodiment except that a plurality of recesses 116 are provided. The features that are identical to those of the first embodiment are denoted by the same numerals and a description or illustration thereof is omitted. FIG. 3A is a horizontal cross sectional view showing the schematic structure of the light emitting member and the light emitting member accommodating unit of the automotive lamp according to variation 1.

The light emitting member accommodating unit 114 of the automotive lamp 1 according to variation 1 is provided with a plurality of recesses 116. The light emitting member 150 is accommodated in each of the plurality of recesses 116. In a state in which the light emitting members 150 are accommodated in the recesses 116, the light incidence surfaces 150*a* and the side surfaces 150*c* of the light emitting member are in contact with the light emitting member accommodating unit 114. In other words, given that the total volume of the light emitting members 150 is equal to the volume of the light emitting member 150 of the first embodiment, the variation represents a case in which the light emitting member 150 of the first embodiment is divided into a plurality of segments and respectively accommodated in the recesses 116.

Thus, the variation increases the total area of contact between the light emitting members 150 and the light emitting member accommodating unit 114 and so increases the heat dissipating efficiency of the light emitting member 150. Also, the volume of the light emitting member 150 accommodated in each of the recesses 116 is reduced so that the heat dissipating efficiency of the light emitting member 150 is further improved. Accordingly, degradation in light emitting efficiency of the light emitting member 150 is further mitigated. FIG. 3A shows four light emitting members 150, but the number of members is not limited to this.

A portion of the light emitting member accommodating unit 114 is interposed between the two adjacent light emitting members 150 as a partition wall. The partition wall is inherently translucent so that a portion of the white light W emitted by the adjacent two light emitting members 150 is directed toward the projection lens 170 from the lateral end face of the partition wall facing the space in front of the lamp. This make the plurality of light emitting members 150 appear as one light emitting unit. The surfaces of the recesses 116 in contact with the side surfaces 150*c* may be provided with a reflecting part formed by, for example, depositing metal. In this case, it is possible to make the light emitting members 150 appear as independent light emitting units and realize a light distribution pattern using the edge portions of the light emitting units.

(Variation 2)

Figure 3B:
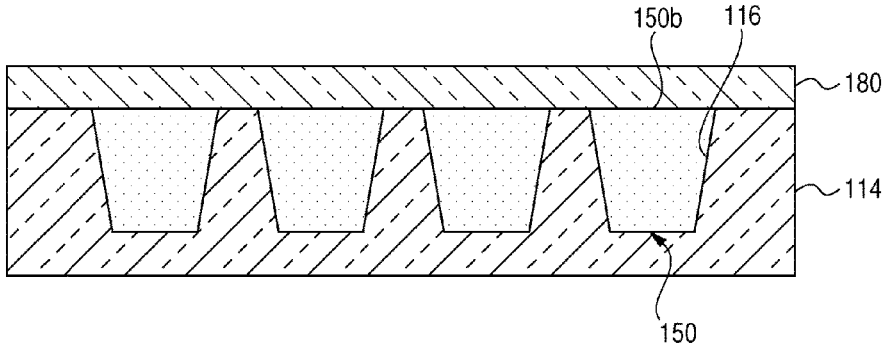
FIG. 3B is a horizontal cross sectional view showing the schematic structure of the light emitting member and the light emitting member accommodating unit of the automotive lamp according to variation 2.

The structure of the automotive lamp 1 according to variation 2 is similar to that of the automotive lamp 1 according to the first embodiment except that a cover member 180 is provided. The features that are identical to those of the first embodiment are denoted by the same numerals and a description or illustration thereof is omitted. FIG. 3B is a horizontal cross sectional view showing the schematic structure of the light emitting member and the light emitting member accommodating unit of the automotive lamp according to variation 2.

The automotive lamp 1 according to variation 2 is further provided with a cover member 180. The cover member 180 is translucent and is in contact with the light emission surface 150*b* of the light emitting member 150 and with the support member 110. In this variation, the cover member 180 is in contact with the light emitting member accommodating unit 114 of the support member 110. The cover member 180 may be in contact only with the body 112 or with the light emitting member accommodating unit 114 and the body 112. The cover member 180 is translucent and so is capable of transmitting the white light W emitted by the light emitting member 150. As well as being translucent, the cover member 180 is formed of a material having a higher thermal conductivity than air. The cover member 180 may be formed of the same material as can be used for the light emitting member accommodating unit 114. The cover member 180 does not substantially contain a phosphor.

Thus, by allowing the light emission surface 150*b* of the light emitting member 150 to be in contact with the cover member 180, the heat generated in the light emitting member 150 can be conducted from the light emission surface 150*b* to support member 110 via the cover member 180. This can increase the heat dissipating efficiency of the light emitting member 150 and mitigate degradation in the light emitting efficiency of the light emitting member 150 more properly. The light emitting member accommodating unit 114 according to this variation has a structure similar to that of variation 1. In other words, a plurality of recesses 116 are provided. Alternatively, the light emitting member accommodating unit 114 may be provided with the same structure as that of the first embodiment, i.e., may be provided with a single recess 116.

(Second Embodiment)

Figure 4A:
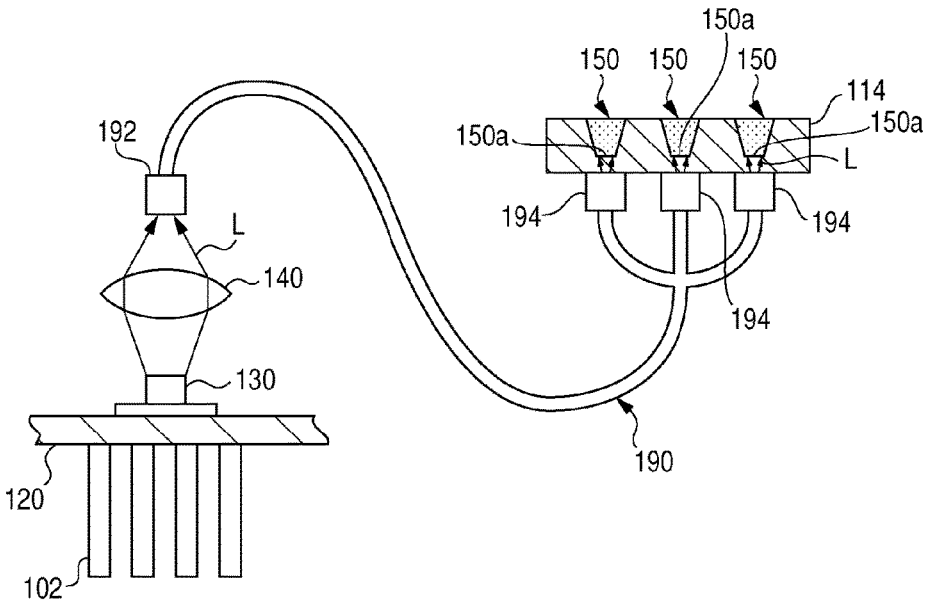
FIG. 4A is a horizontal cross sectional view showing the schematic structure of the light source, the light guiding member, the light emitting member accommodating unit, and the light emitting member in the automotive lamp according to the second embodiment.
Figure 4B:
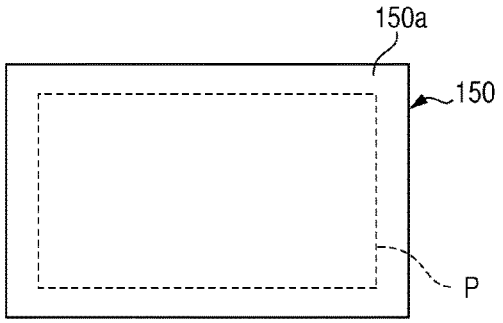
FIG. 4B schematically shows the shapes of the light incidence surface of the light emitting member and the beam pattern of the laser light.

The structure of the automotive lamp 1 according to the second embodiment is similar to that of the automotive lamp 1 according to the first embodiment except that a light guiding member 190 is provided. The features that are identical to those of the first embodiment are denoted by the same numerals and a description or illustration thereof is omitted. FIG. 4A is a horizontal cross sectional view showing the schematic structure of the light source, the light guiding member, the light emitting member accommodating unit, and the light emitting member in the automotive lamp according to the second embodiment. FIG. 4B schematically shows the shapes of the light incidence surface of the light emitting member and the beam pattern of the laser light.

The automotive lamp 1 according to this embodiment is further provided with the light guiding member 190. The light guiding member 190 is formed of a linear member such as an optical fiber. A light incidence part 192 at one end of the light guiding member 190 is disposed toward the light source 130, and light emission parts 194 at the other end are disposed toward the light emitting member 150. The light guiding member 190 is adapted to guide the laser light L incident from the light incidence part 192 to the light emitting member 150 by emitting the light from the light emission parts 194. In other words, the laser light L radiated from the light source 130 is incident on the light incidence part 192 of the light guiding member 190 via the condensing lens 140. The laser light L incident on the light incidence part 192 travels in the light guiding member 190 and reaches the light emission parts 194. The laser light L is emitted from the light emission parts 194 and transmitted through the light emitting member accommodating unit 114, before being incident on the light emitting member 150.

The light emitting member accommodating unit 114 according to this embodiment has a structure similar to that of variation 1. In other words, a plurality of recesses 116 are provided. The number of light emission parts 194 provided in the light guiding member 190 is determined by the number of recesses 116. The light emission parts 194 are adapted to irradiate the light emitting members 150 in the respective recesses 116 with the laser light L. The light emitting member accommodating unit 114 has a structure similar to that of the first embodiment. In other words, a single recess 116 is provided. The cover member 180 may additionally be provided. By providing the light guiding member 190 as described above, the flexibility of arrangement of the light source 130 and the light emitting member 150 can be improved.

As shown in FIG. 4B, the beam pattern P of the laser light L emitted from the light guiding member 190 and the light incidence surface 150*a* of the light emitting member are substantially equal in shape or substantially analogous in shape. More specifically, the light incidence surface 150*a* of the light emitting member and the beam pattern P on the light incidence surface 150*a* of the light emitting member are substantially equal in shape or substantially analogous in shape. Further, the light incidence surface 150*a* of the light emitting member has a shape collapsed in one direction as viewed in the direction of a normal to the light incidence surface 150*a* of the light emitting member. The beam pattern P of the laser light L has a shape collapsed on the light incidence surface 150*a* of the light emitting member in the same direction as the direction in which the light incidence surface 150*a* of the light emitting member 150 is collapsed. In this variation, the light incidence surface 150*a* of the light emitting member and the beam pattern P are both substantially rectangular and are analogous to each other such that the light incidence surface 150*a* of the light emitting member is larger than the beam pattern P. The beam pattern P has a light distribution of a top hat shape.

By configuring the beam pattern P and the light incidence surface 150*a* of the light emitting member to be substantially equal in shape or substantially analogous in shape, the laser light L can be incident on the light emitting member 150 efficiently. This improves the external quantum efficiency of the light emitting member 150 and improves the light emitting efficiency of the light emitting member 150.

Further, the automotive lamp 1 according to this variation is configured such that the relationship between the shape of the light incidence surface of the light incidence part 192 and the shape of the beam pattern P is similar to the relationship between the shape of the light incidence surface 150*a* of the light emitting member and the shape of the beam pattern P. In other words, the light incidence surface of the light incidence part 192 of the light guiding member 190 and the beam pattern P of the laser light L on the light incidence surface of the light incidence part 192 are substantially equal in shape or substantially analogous in shape. The description with reference to FIG. 4B applies to the shapes of the light incidence surface of the light incidence part 192 and the beam pattern P, by replacing the light incidence surface 150*a* of the light emitting member of FIG. 4B with the light incidence surface of the light incidence part 192 of the light guiding member 190. In this way, the laser light L can be incident on the light guiding member 190 efficiently. Accordingly, the light emitting efficiency of the light emitting member 150 can be improved.

The embodiments of the present invention are not limited to those described above and the embodiments and variations may be combined, or various further modifications such as design changes may be made based on the knowledge of a skilled person. The embodiments and variations resulting from such combinations or further modification are also within the scope of the present invention. New embodiments created by combinations of the above-described embodiments and variations and by combinations of the following variations with the above-described embodiments and variations provide combined advantages from the embodiments, variations, and further modifications.

The lamp unit 100 in the above-described embodiments and variations is a lamp unit of projector type. The type of the lamp unit 100 is not limited to this and the lamp unit may be of reflective type. The light emitting member 150 is described as radiating the white light W but may alternatively radiate light of other colors such as amber colored light. The light source 130 may an LED so long as the light emitting member 150 is used. The automotive lamp 1 has a transmission type structure in which the laser light L is incident on one of the surfaces of the light emitting member 150 (the light incidence surface 150*a* of the light emitting member) and the white light W is emitted from the other surface (the light emission surface 150*b*) opposite to the surface of incidence. However, the type of the automotive lamp 1 is not limited to this. For example, the automotive lamp 1 may have a reflection type structure in which the laser light L is incident on one of the surfaces (e.g., the light emission surface 150*b*) and the white light W is emitted from the surface of incidence. The automotive lamp 1 may be a sine lamp or a tail lamp.

What is claimed is:

1. An automotive lamp comprising:

a light source;

a light emitting member that receives light from the light source and emits light; and a support member that supports the light emitting member, wherein the support member includes a translucent light emitting member accommodating unit, the light emitting member accommodating unit includes a recess in which the light emitting member is accommodated, a light incidence surface and side surfaces of the light emitting member are in contact with the light emitting member accommodating unit in a state in which the light emitting member is accommodated in the recess, and on a surface of the light emitting member accommodating unit that is in contact with a side surface of the light emitting member is provided a rough surface area having a surface roughness greater than that of a light incidence surface of the light emitting member accommodating unit, and the side surface of the light emitting member is a surface connecting the light incidence surface of the light emitting member and a light emission surface which faces away from the light incidence surface and from which light generated inside the light emitting member is emitted, and the side surface of the light emitting member has a rough surface area having a surface roughness greater than that of the light incidence surface of the light emitting member.

2. The automotive lamp according to claim 1, wherein the light emitting member accommodating unit includes a plurality of recesses, and the light emitting member is accommodated in each of the plurality of recesses.

3. The automotive lamp according to claim 1, wherein the light incidence surface of the light emitting member has a shape collapsed in one direction as viewed in the direction of a normal to the light incidence surface, and the light source is a laser light source and a beam pattern of laser light radiated from the light source has a shape collapsed on the light incidence surface of the light emitting member in the same direction as the direction in which the light incidence surface of the light emitting member is collapsed.

4. The automotive lamp according to claim 1, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

5. The automotive lamp according to claim 1, further comprising:

a translucent cover member that is in contact with a light emission surface of the light emitting member and with the support member.

6. The automotive lamp according to claim 2, wherein the light incidence surface of the light emitting member has a shape collapsed in one direction as viewed in the direction of a normal to the light incidence surface, and the light source is a laser light source and a beam pattern of laser light radiated from the light source has a shape collapsed on the light incidence surface of the light emitting member in the same direction as the direction in which the light incidence surface of the light emitting member is collapsed.

7. The automotive lamp according to claim 5, wherein the light incidence surface of the light emitting member has a shape collapsed in one direction as viewed in the direction of a normal to the light incidence surface, and the light source is a laser light source and a beam pattern of laser light radiated from the light source has a shape collapsed on the light incidence surface of the light emitting member in the same direction as the direction in which the light incidence surface of the light emitting member is collapsed.

8. The automotive lamp according to claim 2, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

9. The automotive lamp according to claim 3, further comprising:

a light guiding member that is disposed such that one end is toward the light source and the other end is toward the light emitting member, and guides light to the light emitting member, wherein a beam pattern of laser light emitted from the light guiding member and the light incidence surface of the light emitting member are substantially equal in shape or substantially analogous in shape.

10. The automotive lamp according to claim 5, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

11. The automotive lamp according to claim 6, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

12. The automotive lamp according to claim 2, further comprising:

a translucent cover member that is in contact with a light emission surface of the light emitting member and with the support member.

13. The automotive lamp according to claim 7, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

14. The automotive lamp according to claim 12, further comprising:

a light guiding member that is disposed such that one end is toward the light source and the other end is toward the light emitting member, and guides light to the light emitting member, wherein the light source is a laser light source, and a beam pattern of laser light emitted from the light guiding member and the light incidence surface of the light emitting member are substantially equal in shape or substantially analogous in shape.

15. The automotive lamp according to claim 4, further comprising:

a translucent cover member that is in contact with a light emission surface of the light emitting member and with the support member.

16. The automotive lamp according to claim 3, further comprising:

a translucent cover member that is in contact with a light emission surface of the light emitting member and with the support member.

* * * * *